US005467790A

United States Patent [19]

Heckler

[11] Patent Number: 5,467,790

[45] Date of Patent: Nov. 21, 1995

[54] MANIFOLD AND VALVE BLOCK ASSEMBLY

[75] Inventor: Chris Heckler, Rockford, Ill.

[73] Assignee: PepsiCo, Inc., Purchase, N.Y.

[21] Appl. No.: 90,501

[22] Filed: Jul. 13, 1993

[51] Int. Cl.[6] ..... B08B 9/08

[52] U.S. Cl. ..... 134/66; 134/79; 134/153; 134/167 R; 134/95.3

[58] Field of Search ..... 134/50, 51, 52, 134/62, 66, 79, 134, 142, 144, 149, 153, 167 R, 95.3; 137/625.11, 625.18, 627

[56] References Cited

U.S. PATENT DOCUMENTS

| | | | |
|---|---|---|---|
| 908,446 | 1/1909 | Court | 134/144 |
| 934,870 | 9/1909 | Wolfensberger | 134/167 R X |
| 1,055,220 | 3/1913 | Pindstofte | 134/152 |
| 2,730,068 | 1/1956 | Reynolds et al. . | |
| 2,818,873 | 1/1958 | Carlson et al. . | |
| 3,131,868 | 5/1964 | Coleman | 239/391 |
| 3,226,757 | 1/1966 | Shea . | |
| 3,563,256 | 2/1971 | Babunovic | 134/144 |
| 3,799,453 | 3/1974 | Hart | 239/391 |
| 3,886,958 | 6/1975 | Diebel et al. . | |
| 4,051,805 | 10/1977 | Waldrum | 134/152 X |
| 4,080,974 | 3/1978 | Oag | 134/152 X |
| 4,442,934 | 4/1984 | Dorf et al. . | |
| 4,527,742 | 7/1985 | Vogt et al. | 239/391 |
| 4,834,123 | 5/1989 | McBrady | 134/152 |

FOREIGN PATENT DOCUMENTS

| | | |
|---|---|---|
| 0180706 | 5/1986 | European Pat. Off. . |
| 94110834 | 11/1994 | European Pat. Off. . |
| 408950 | 4/1910 | France . |
| 991641 | 10/1951 | France . |
| 492206 | 2/1930 | Germany . |
| 3316405 | 11/1984 | Germany . |
| 4016950 | 11/1991 | Germany . |
| 3114503 | 5/1991 | Japan . |
| 377444 | 7/1932 | United Kingdom . |

*Primary Examiner*—Frankie L. Stinson
*Attorney, Agent, or Firm*—Scully, Scott, Murphy & Presser

[57] ABSTRACT

A manifold and valve block assembly, particularly for a bottle washer designed for plastic returnable bottles. The manifold and valve block assembly provides for the successive supply of a plurality of different cleansing and sanitizing solutions, and also for residual fluid removal and drying, to an internal spray nozzle positioned within a bottle being cleaned, and also to spray nozzles positioned externally of the bottle. The internal spray nozzle is mounted on a lance which is driven by different fluids between a fully retracted position within the valve block assembly and a fully extended position in which it is positioned within a bottle being cleaned. The lance is longitudinally movably positioned within a drive cylinder, and has a central fluid flow passageway which communicates with the spray nozzle mounted on the upper end thereof. A plurality of valves are mounted in the valve block assembly, including a static air valve which supplies air under pressure to the top of the lance to drive it downwardly to its retracted position. Several of the valves supply different cleaning and sanitizing solutions, and also air for residual fluid removal and drying, to a common manifold which provides a fluid passage to the central fluid flow passageway of the lance for the fluids to be sequentially sprayed through the nozzle.

29 Claims, 8 Drawing Sheets

MANIFOLD AND VALVE BLOCK ASSEMBLY

BACKGROUND OF THE INVENTION

1. Field of the Invention

The present invention relates generally to a manifold and valve block assembly, and more particularly pertains to a manifold and valve block assembly for a bottle washer designed particularly for plastic returnable bottles. The manifold and valve block assembly provides for the successive supply of a plurality of different cleansing and sanitizing solutions, and also air for residual fluid removal to an internal spray nozzle positioned within a bottle being cleaned, and also optionally to spray nozzles positioned externally of the bottle. The internal spray nozzle is mounted on a lance which is driven by different fluids between a fully retracted position within the valve block assembly and a fully extended position in which the nozzle is positioned within a bottle being cleaned.

2. Discussion of the Prior Art

Existing returnable bottle washers depend upon dragging bottles, held loosely by carriers, through large soaking tanks of hot caustic solution. In contrast thereto, the bottle washer disclosed herein, which includes as one component the manifold and valve block assembly of the present invention, positively holds each bottle and utilizes spray impingement to clean the bottles. This approach increases the life of the plastic returnable bottle by reducing scuffing, stress cracking and shrinking caused by traditional bottle washers. Additionally, the present invention should reduce costs associated with washing by improving line efficiency, and reducing floor area, chemical costs, and utility costs. The present invention also provides for inserting the nozzle into the bottle, and recycling of the cleaning solutions.

SUMMARY OF THE INVENTION

Accordingly, it is a primary object of the present invention to provide a manifold and valve block assembly, and more particularly a manifold and valve block assembly for a bottle washer designed particularly for plastic returnable bottles. The manifold and valve block assembly provides for the successive supply of a plurality of different cleansing and sanitizing solutions, and also air for residual fluid removal to an internal spray nozzle positioned within a rotationally driven bottle being cleaned, and also optionally to spray nozzles positioned externally of the bottle. The internal spray nozzle is mounted on a lance which is driven by different fluids between a fully retracted position within the valve block assembly and a fully extended position in which the nozzle is positioned within a bottle being cleaned.

In greater particularity, the subject invention provides a manifold and valve block assembly for a rotary type plastic returnable bottle washing machine that will enable single file infeed and positive bottle control throughout with spray impingement for Plastic Returnable Bottles (PRB) between the sizes of 0.5 Liter and 2.0 Liter. The rotary washing machine incorporates therein two carousel machines that are basically identical. The first wash carousel performs an approximately 13 second (245°) caustic cycle, which includes at the end thereof an approximately 2 second (38°) air purge/evacuation of the residual alkaline caustic solution within the bottle and associated fluid flow passages. This is followed by an approximately 1.36 second (26°) neutralizer rinse cycle. The bottles are then transferred to a second sanitizer carousel which provides an approximately 10 second (188.6°) disinfectant rinse, followed by an approximately 4.86 second (92°) final soft water rinse before the bottles exit the machine. In the preferred embodiment, the carousel speeds are controlled to produce cleaned and sanitized bottles to a downstream filler at a rate of 440 bottles/min.

In general, the washed bottles should be sanitary to a maximum of 10 counts yeast, 10 counts mold, and 10 counts bacteria, and should have no caustic cleanser or sanitizer carryover.

A further object of the subject invention is the provision of a plastic returnable bottle washer which provides for improved plastic returnable bottle life by reducing scuffing, reducing stress cracking, reducing shrinkage, and reducing contact time with high temperature washing detergents. The washer improves plastic returnable bottle operating efficiency by increasing the average number of returns for each bottle, and enabling operation with different size bottles. The washer utilizes in-line handling and positive control of the bottles in a rotary washer which washes at a higher speed by the use of spray impingement in which spray nozzles are inserted into rotationally driven bottles to achieve cleaning, and which provides a separate sanitation cycle from the cleaning cycle.

In accordance with the teachings herein, the present invention provides a manifold and valve block assembly comprising a valve block housing in which a drive cylinder is mounted. A spray lance with a piston is longitudinally movably positioned within the drive cylinder, and has a central fluid flow passageway, and a spray nozzle mounted on a first upper end thereof. The spray nozzle is removably and replaceably mounted on the lance, to allow the nozzle to be replaced for different size bottles. The lance has a retracted position in which it is positioned fully retracted within the driving cylinder, and a fully extended position in which the fully extended lance positions the spray nozzle for spray impingement of a fluid through the nozzle. A plurality of valves are mounted in the valve block housing for supplying a plurality of spray fluids to a common manifold which provides a fluid passage to the central fluid flow passageway of the lance for the fluids to be sequentially sprayed through the nozzle. In addition, a static air supply valve supplies static air under pressure to the top of the piston when the lance is in a fully extended position, to drive the lance downwardly to its retracted position. A static dump valve is actuated simultaneously with the static air supply valve which allows, as the lance is driven downwardly by the static air under pressure, any fluid in the drive cylinder to be evacuated therefrom into a collection trough positioned therebeneath.

Each static air valve comprises a three-way valve which, in a first position, allows static air to flow through the valve to the top of its associated lance to pneumatically drive the lance to its retracted position. In a second position, the valve allows air to be vented from the drive cylinder on top of the lance through the valve to the atmosphere, whereby when the lance is driven to its extended position, air from the drive cylinder on top of the lance is vented through the static air valve to the atmosphere. The plurality of valves include several two-way valves, each of which has an open position which allows fluid to flow through the two-way valve to the bottom of the lance to drive the lance to its extended position and to be sprayed through the nozzle, or if the lance is already in its extended position, to be sprayed through the nozzle, and a closed position which prevents the flow of fluid through the valve. The three-way valves and two-way valves have substantially similar constructions with identical housings and identical valve stem assemblies, with each valve stem assembly comprising a main valve and a vent valve. Each three-way valve differs from each two-way valve by being provided with additional ports to enable operation of the vent valve.

In greater particularity, the manifold and valve block assembly is mounted in a bottle cleaning machine for cleaning bottles, in which the manifold and valve block assembly is associated with a bottle being washed, and the fully extended position of the lance positions the spray nozzle internally within the bottle for spraying of the internal surfaces thereof. In one designed embodiment, the bottle cleaning machine includes at least one carousel wheel which has a plurality of bottle mounts around its circumference for mounting a plurality of bottles being cleaned in inverted positions, and each bottle mount on the carousel has a separate manifold and valve block assembly associated therewith. The carousel includes a plurality of annular fluid supply manifolds positioned around its inner circumference to supply fluid from each fluid supply manifold to one of the plurality of associated valves in the plurality of manifold and valve block assemblies positioned around the circumference of the carousel. Each valve is actuated by a cam track for that valve positioned around the outer circumference of the carousel such that as the carousel rotates a valve actuator for that valve is moved into contact with its associated cam track.

In a preferred embodiment, the bottle cleaning machine includes two substantially identical carousels, a first bottle washing carousel and a second bottle sanitizing carousel. The bottle cleaning machine passes bottles in an inverted position, neck down, first to an inlet transfer wheel for transferring bottles into the bottle washing carousel, around which the bottles are rotated to a transfer wheel for transferring the bottles to the sanitizing carousel, around which the bottles are rotated to an exit transfer wheel for transferring the bottles to an exit conveyor.

One annular fluid supply manifold in each carousel supplies static air under pressure to a plurality of static air valves in the plurality of manifold and valve block assemblies positioned around the carousel. The static air from each static air valve passes to the top of an associated lance in its fully extended position to pneumatically drive the lance downwardly to its fully retracted position. During retraction of each lance, a static dump valve is opened simultaneously with the static air valve, which allows any fluid within the drive cylinder to be evacuated therefrom.

A second annular fluid supply manifold in the first washing carousel supplies an alkaline wash solution under pressure to a plurality of alkaline wash solution valves in the plurality of manifold and block assemblies. A third annular fluid supply manifold in the first washing carousel supplies an acid neutralizer rinse under pressure to a plurality of neutralizer rinse valves in the plurality of manifold and block assemblies.

In the sanitizing carousel, a second annular fluid supply manifold supplies an acidic disinfectant rinse solution under pressure to a plurality of disinfectant rinse valves in the plurality of manifold and block assemblies positioned around the sanitizing carousel. A third annular fluid supply manifold in the second sanitizing carousel supplies a final soft water rinse under pressure to a plurality of soft water rinse valves in the plurality of manifold and block assemblies.

In greater detail, the common manifold in the manifold and valve block assembly directs fluid from one of several of the valves into fluid ingress passages near the bottom of the drive cylinder which enters the central fluid passageway of the lance. If the lance is in a retracted position, the fluid drives the lance to its fully extended position, and the fluid is then sprayed through the nozzle in its fully extended position. If the lance is initially in its fully extended position, the fluid is simply sprayed through the nozzle. Each of the manifold and valve block assemblies in the wash and sanitize carousels includes at least a static air valve, a static dump valve, and at least two additional fluid supply valves. In addition, the manifold and valve block assemblies in the wash carousel include an air purge valve for purging the drive cylinder, the common manifold, and associated fluid flow passages of the alkaline washing solution.

Additionally, the two carousel approach described herein could be replaced by a single carousel having the successive cleaning and sanitizing stages or cycles described herein performed successively around the single carousel. The and speed of operation of the carousel could be varied to suit particular cleaning and sanitizing operations.

Moreover, the manifold and valve block assembly of the present invention should have utility in other types of bottle or container processing equipment which require spraying of solutions internal to the bottle or container.

BRIEF DESCRIPTION OF THE DRAWINGS

The foregoing objects and advantages of the present invention for a manifold and valve block assembly may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

PRB Washing and Sanitizing System

The automatic Plastic Returnable Bottle (PRB) washing and sanitizing system utilizes relatively commonplace bottle handling equipment such as conveyors, worms, inverters, starwheels, etc. and two specialized rotating horizontal carousel type wheels which hold the bottles in place for respective washing and sanitizing, as described in further detail in U.S. patent application Ser. No. 08/090,503, filed Jul. 12, 1993.

Bottle Flow Sequence

Figure 1:
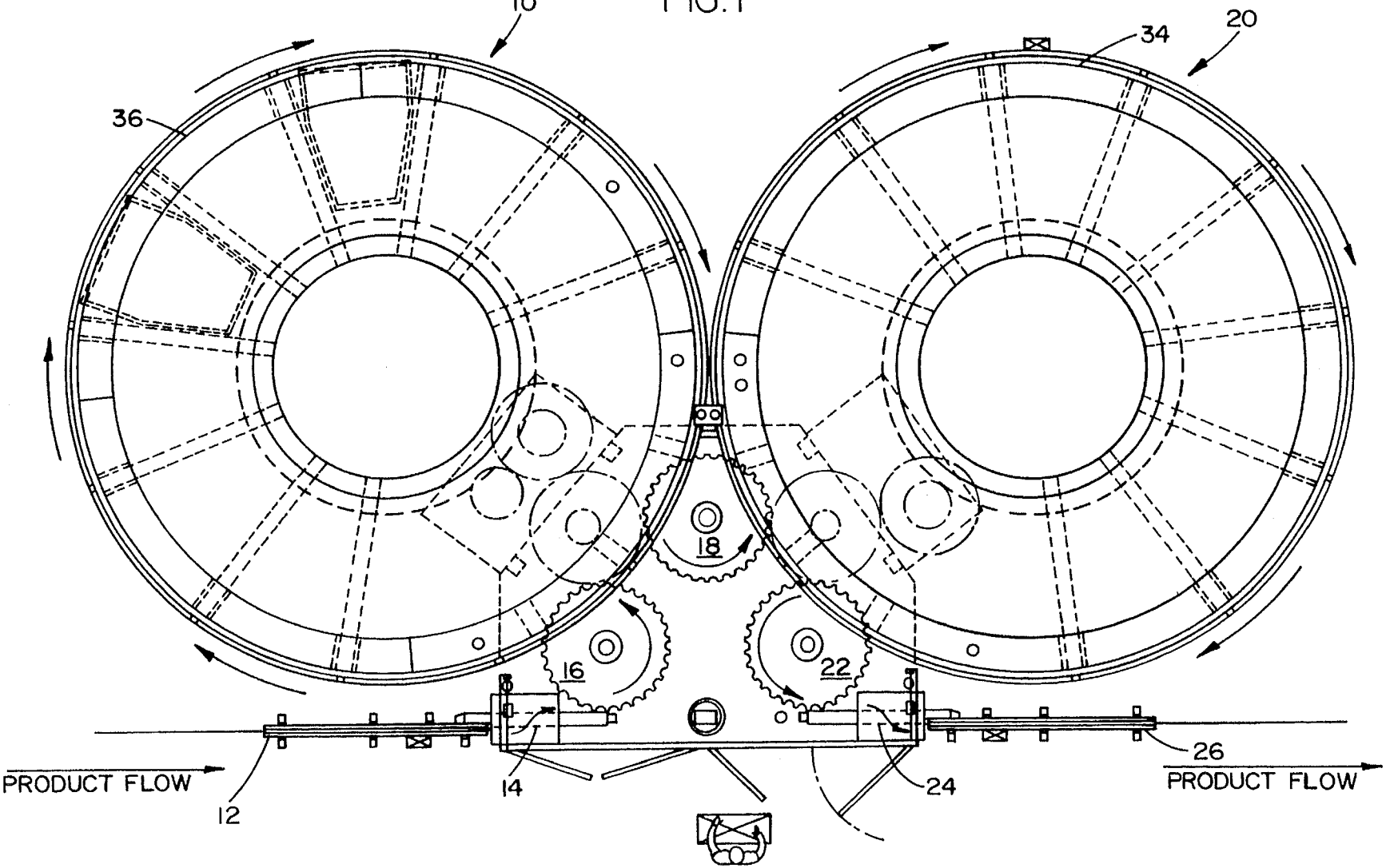
FIG. 1 illustrates a top plan view of one embodiment of a bottle washing and sanitizing machine, and illustrates the flow of bottles through an inlet transfer starwheel to and around a first wash carousel, from which the bottles are transferred by a transfer starwheel to and around a second sanitizing carousel, from which the bottles are removed by an outlet transfer starwheel, from which the bottles can be transferred to a filling machine.

Referring to FIG. 1, bottles enter a first wash carousel wheel 10 by an infeed conveyor 12, are inverted by a worm/inverter 14, and then proceed through a starwheel infeed device 16 which grips each inverted bottle by a vacuum holder. To minimize scuffing and abrasion to external bottle surfaces, the several devices are designed to handle the bottles with minimum mechanical contact, and are equipped with suction cups, vacuum nozzles, air jets, etc. to affect bottle conveying. Once transferred to the first wash carousel 10 in a neck down position as illustrated in FIGS. 3, 4, 5 and 6, a bottle is gripped around its neck ring by neck ring gripper/rollers, as described in greater detail in U.S. patent application Ser. No. 08/090,413, filed Jul. 12, 1993, for a Workpiece Holding and Rotating Device and held in position throughout its traversing the carousel. The neck ring gripper/rollers are powered by drive motors and belts that impart a controlled spinning action to the bottle. The controlled spinning or rotation is very effective for both washing and sanitizing as it provides for maximum coverage of solutions at minimum volumes to both the internal and external surfaces of the bottle.

Figure 2:
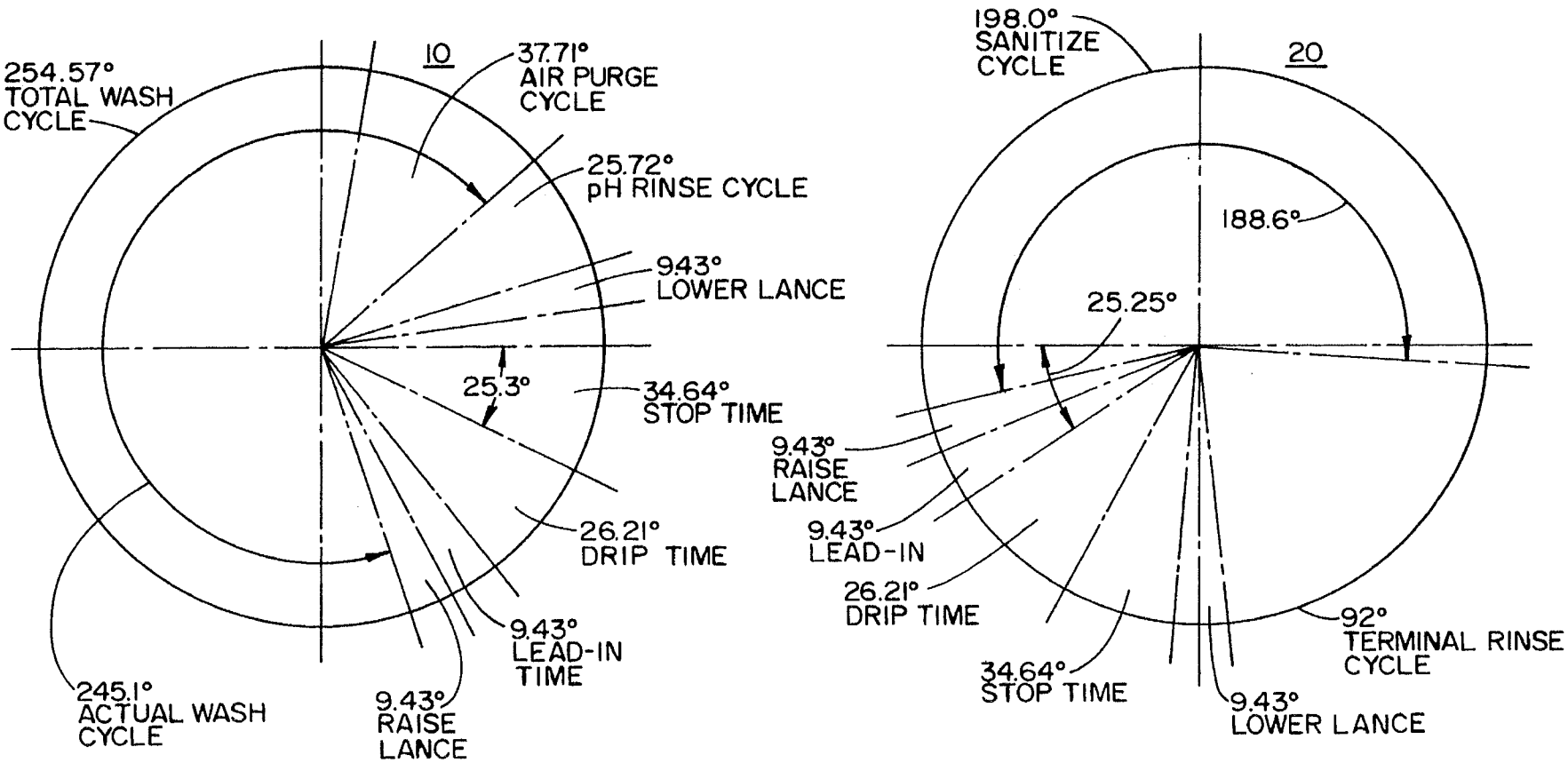
FIG. 2 illustrates the timing cycles of the two carousels, including in the wash carousel, a lead-in cycle, a lance raise cycle (arc), an alkaline wash cycle, a neutralize rinse cycle, and a lower lance cycle, and in the sanitize carousel, a lead-in cycle, a lance raise cycle, a sanitize rinse cycle, a terminal rinse cycle, and a lower lance cycle.

FIG. 2 illustrates the following timed cycles or sequences by appropriate arcs around the first wash carousel and the second rinse carousel. During an initial 9.43 degree lead-in arc, the gripper closes around the bottle neckring. During the next 9.43 degrees, a lance with a spray nozzle at its tip is inserted into each bottle. As a bottle is conveyed through the next 245 degrees of the first wash carousel, it is sprayed both internally and externally by a hot alkaline solution that solubilizes and removes typical soils found in returned used beverage bottles. The internal spraying is by a specially designed spray nozzle mounted on a lance which is driven by a fluid driven piston. The lance has an exact and precise travel distance within the confines of the bottle envelope and is lowered or recalled by air pressure just prior to the bottle leaving each carousel.

At the end of the 245 degrees conveyance (13 sec), 38 degrees (2 sec) of travel are allocated for an air purge/evacuation of residual alkaline solution within the bottle. With the lance still extended, this air purge is followed immediately by a neutralizing, slightly acidic rinse for a 26 degree duration, and then the lance is lowered during a 9.43 arc. This approach minimizes the time waiting for gravity drainage of solutions to provide for the recovery and reutilization of the solution.

The bottle is then transferred by a transfer starwheel 18 a second sanitizer carousel 20 which is substantially identical in size and number of stations to the first carousel, and differs only slightly in structure from the wash carousel because of its different function. During conveyance by the second sanitizer carousel 20, the gripper closes around the bottle neckring during the first 9.43° arc. Then 9.43° is allocated for lance raise time, followed by a 188.6 degrees arc allocated to the application of a sanitizing solution only to the interior of the bottle. This is followed by a final or terminal rinse of treated water applied to both internal and external bottle surfaces for approximately 92 degrees, followed by a 9.43° lance lower arc.

In both carousels, at the end of each treatment, free clean air is applied to an external stationary (does not rotate with the carousel) spray nozzle positioned above the bottoms of the inverted plastic returnable bottles to blow off any residual liquids in the concave bottoms of the inverted bottles to provide maximum recovery and minimum migration of cleaning and sanitizing fluids. In greater detail, one such stationary nozzle is positioned above the inverted bottles at the end of the wash cycle, one such stationary nozzle is positioned above the inverted bottles at the end of the pH rinse cycle, one such stationary nozzle is positioned above the inverted bottles at the end of the sanitize cycle, and one such stationary nozzle is positioned above the inverted bottles at the end of the terminal rinse cycle.

The bottles are then removed from the rinse carousel by an outlet starwheel 22, and transferred to an outgoing feedscrew 24 which again inverts the bottle again to its original neck up position, from which it is conveyed at 26 as a cleaned and sanitized package to the product filler.

During this whole process, and as described in U.S. patent application Ser. No. 08/090,595filed Jul. 12, 1993, a programmable logic controller (PLC) maintains, manages, and controls carousel, infeed/outfeed conveyors, and bottle rotation drive motor speeds based on feedback from the downstream bottle filler. Additionally, the PLC monitors and controls pumps, valves, solenoids, motor starters, as required by the process and also provides for monitoring and adjustment of fluid levels, alkalinity/acidity concentrations, and temperature of the recirculated wash solution.

As illustrated in FIG. 1, a machine operator may view, from a centrally located intelligent operator interface, all of the machine present parameters displayed on various alphanumeric screens of the interface. Accordingly, any alarm conditions that may occur during the process and require some type of human interaction or intervention are displayed, and will prompt for an operator acknowledgement.

Some alarm conditions are out of range, flow, temperature, pressure, conductivity and/or pH, fluid level, carousel rpm, and include separate and specialized checks for clogged spray nozzles, lances out of position, fouled line strainers, etc. Safety related items are shown as alarm conditions as well, for example, inspection doors open, overtemp condition, exhaust fan not running, utilities pressures too low to start, lubrication required, etc.

Figure 3A:
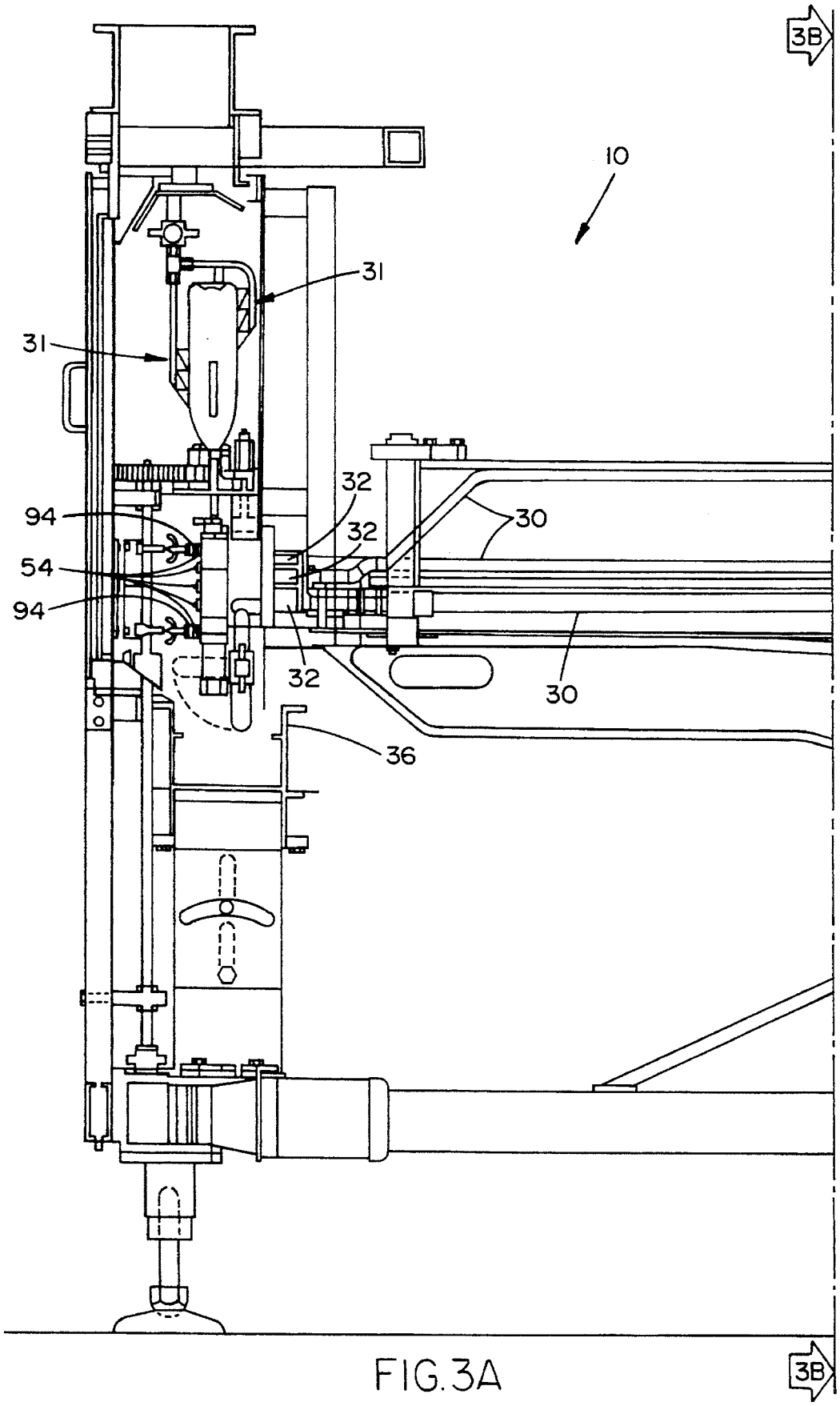
FIG. 3 is a partially sectional view of one half the first wash carousel, and illustrates cams simultaneously actuating a static air valve and a static air dump valve, the fluid flow conduits in the machine, and also a wash reclamation trough positioned beneath the first wash carousel.
Figure 3B:
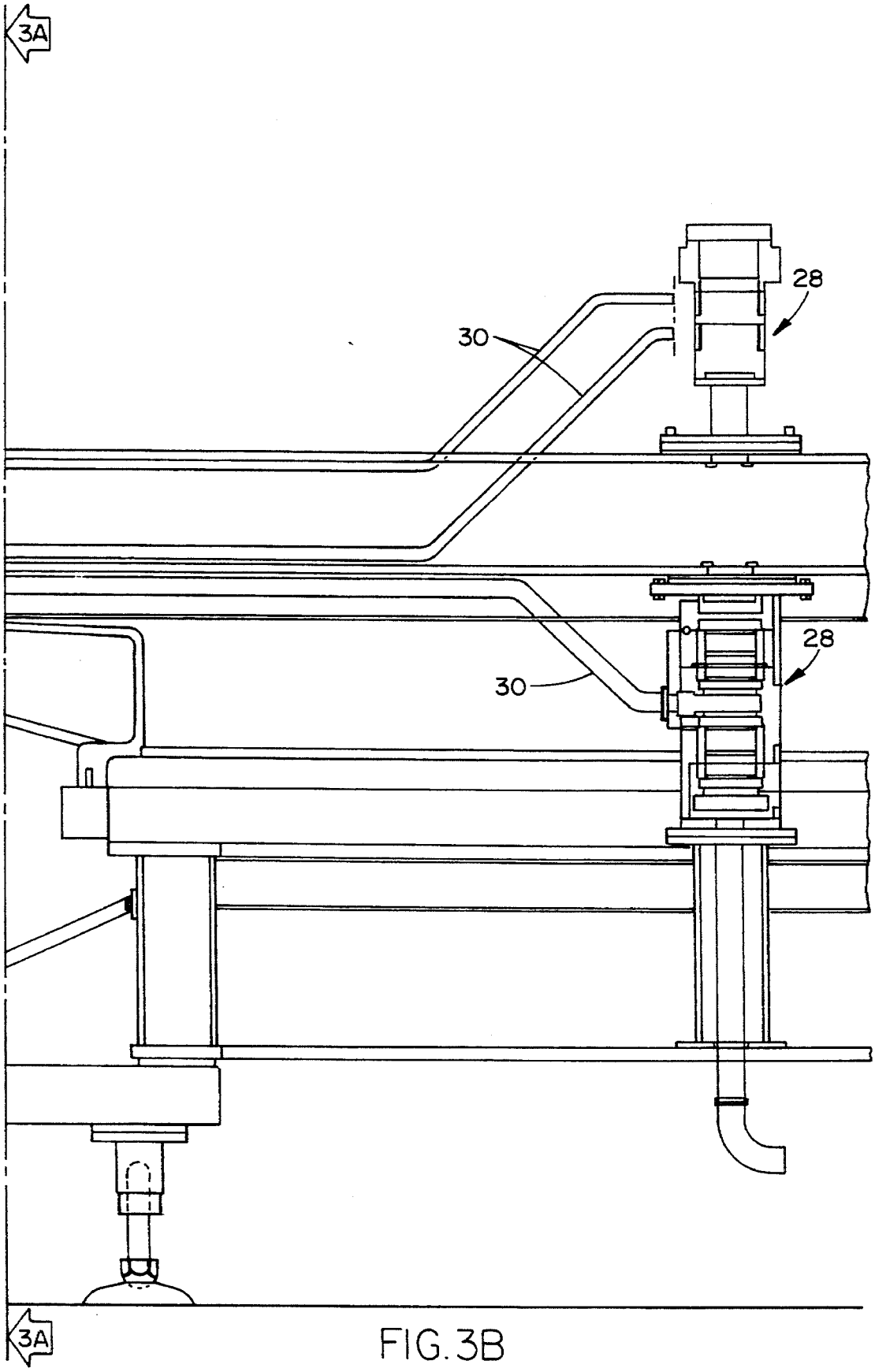
Figure 5:
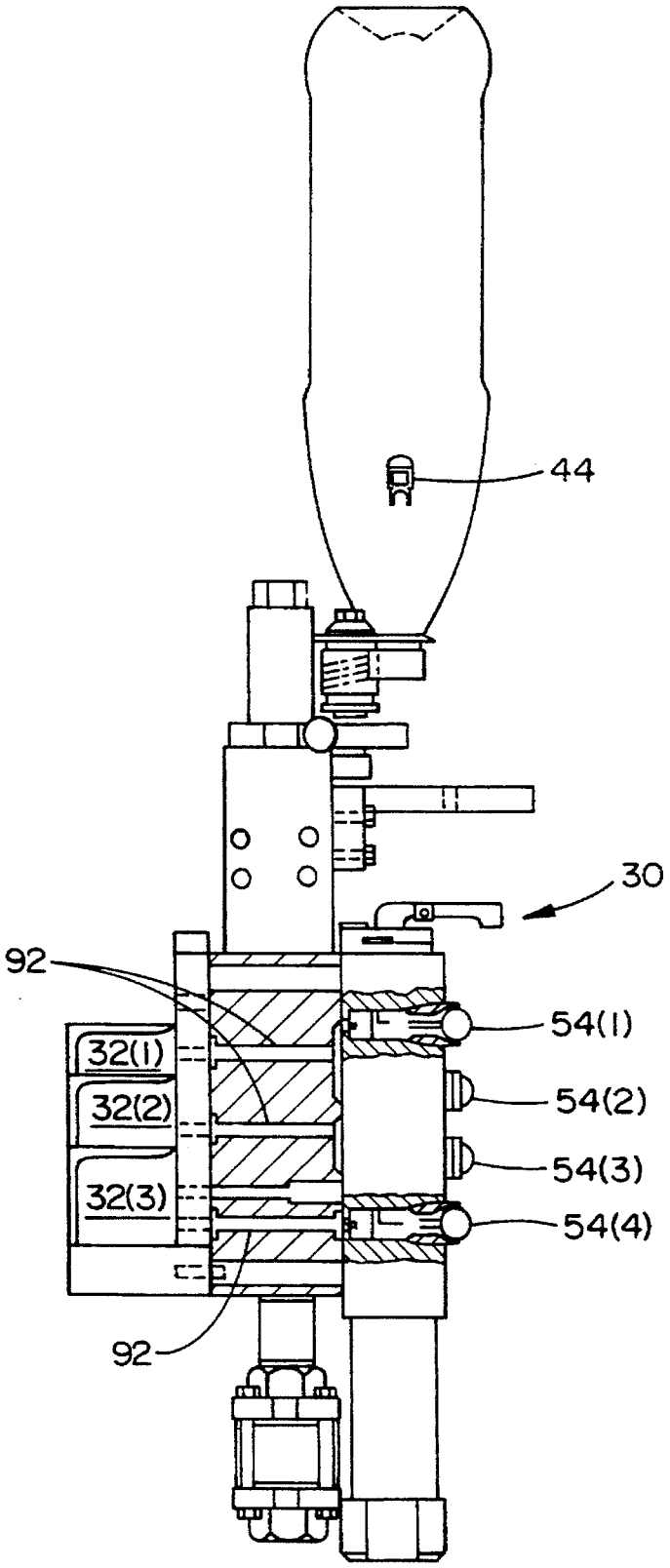
FIG. 5 illustrates a further sectional view through the manifold and valve block assembly for the sanitizing carousel, taken in a 180° opposite direction from the sectional view of FIG. 4, and illustrates several annular supply manifolds, for supplying fluids to the valves, and also illustrates a sectional view through and the operation of two of the supply valves.

The wash carousel 10 and the sanitize carousel 20 both include a central rotary union 28, as illustrated generally in FIG. 3, with several fluid supply lines 30, each of which extends to a separate fluid supply annular manifold 32 extending around the inner circumference of the carousel annulus, as illustrated in FIGS. 3 and 5. As also illustrated in FIG. 3, a plurality of external spray nozzles 31 are mounted around the bottles to clean and sanitize the external surfaces thereof. In a preferred embodiment, the external spray nozzles 31 are stationarily mounted (do not rotate with the carousel) at selected positions around the rotating carousels where the external surfaces of the bottles are to be sprayed with a treatment fluid. In greater detail, the external spray nozzles are positioned along the travel arc of the wash cycle, along the travel arc of the pH rinse cycle, and can optionally be positioned along the travel arc of the sanitize cycle, and along the travel arc of the terminal rinse cycle. The stationary external spray nozzles have a separate fluid supply (not through an annular manifold) since they do not rotate with the carousel.

The neutralizing solution is pumped through a flow monitoring element, the wash carousel rotary union 28, the neutralizer annular supply manifold 32, and finally through a valve and manifold to a lance and interior spray nozzle. The flow monitoring element is a very sensitive flow measuring device for measuring small differences in flow rates. Should a nozzle be plugged, the signal rate will be lower and the suspect nozzle(s) is flagged and retained in PLC memory. That particular station or stations and more importantly, their corresponding bottles, are held in memory throughout the bottle flow sequence. Those bottles are then identifiable for subsequent inspection and rejection stations and may then be rejected as being of uncertain quality.

Fresh sanitizing solution is pumped from a sanitize solution supply tank through a flow measuring element, the sanitize carousel rotary union, sanitizer annular supply manifold, and finally through a valve and common manifold to the lance and interior spray nozzle. As described above, the flow element is a very sensitive flow measuring device that detects small differences in flow rates. The tracking and rejection sequence is essentially the same as the above description.

The recirculating wash circuit of the wash carousel stands alone in its operation, and is essentially a loop where solution strength, filtering, levels and temperature are monitored, adjusted and maintained to operating specifications. The control strategy meets make-up conditions imposed by migration of solution by bottle carryover, evaporation and dilution. In addition, flows and pressures are monitored for overall performance data, and assist in detecting component discrepancies: wear, erosion, leakage, etc.

A separate diverter loop maintains temperature while preventing over exposure spray contact time to the bottles should the carousel be in an idle or resting mode.

Wash solution fluid is pumped from a wash surge/supply tank through one of two parallel mounted filters through a flow element, shell and tube heat exchanger, temperature element, overtemp switch, pressure element, and valves which provide for diverter operation when the carousels are at rest. The fluid is supplied to an external bottle spray header, and to the wash carousel rotary union, wash solution annular supply manifold, and finally through a valve and common manifold to the lance and interior spray nozzle. The external spray header supplies fluid to a plurality of stationary mounted spray nozzles mounted around the bottles in the carousel which spray fluid onto the bottles' exterior surfaces as the bottles are transported thereby by the carousel.

All of the wash solution collects in a separate drain trough 36 and gravity returns to a collection tank, from which the wash solution is pumped back to the wash surge/supply tank to complete the circuit.

Wash and Sanitize Carousels

The wash carousel 10 is provided with a recirculating loop to sustain and maintain temperature, detergent concentrations, liquid volumes, and filtering required to spray clean by impingement the external and internal surfaces of PR bottles.

The sanitize carousel 20 duplicates operationally the wash carousel with the notable exceptions of the spray solutions, the ambient solutions temperatures, special recovery techniques, and the application of a different detergent solution.

1. Temperature. The recirculating wash cycle has operating controls and functions for maintaining the temperature of the wash solution at approximately 140° F. Controls are analog to provide for finite, precise and continual adjustment against losses incurred by water make-up, ambient room temperatures, air movement, etc.

2. Filtering. The recirculated wash solution is continually filtered or strained to guard against clogging of the spray nozzles.

As the bottle is washed, the solution with attendant soils and debris collects by gravity in a circular ring type trough immediately under the carousel. This trough is fitted around the entire circumference of the wash carousel with a perforated sheet metal that permits water to pass through but captures larger solids and debris. The pitch of this sheet allows the debris to be continually flushed to a low point, easily accessible for manual removal. The water and some smaller solids drain from the trough into a collection/return tank similarly equipped with a perforated metal strainer but with smaller openings to entrap still more solids and debris.

This return solution is now pumped back via a variable frequency drive pump to the wash surge and supply tank. Again, this tank has a perforated metal strainer that removes still smaller entrapped solids and debris and allows the solution to be returned back to the wash carousel via a supply pump and final filtering. Final filtering is accomplished by twin filters connected in parallel, sequentially staged, and fitted with automatic valving for switching from/to dirty/clean filters.

A pressure differential element examines the pressure on the inlet side of the filter and compares that with the pressure on the outlet side of that filter. If the difference is too great, the filter is assumed to be near saturation, and valves are simultaneously operated to shut off the first parallel filter and to open the second parallel filter, thus supplying a fresh filter without having to shut down the bottle washing operation. After acknowledging the clogged filter alarm, the machine operator cleans and replaces the saturated strainer filter for the next transition.

3. Tankage. All tanks are of stainless steel construction, and are equipped with liquid level controls of an analog operating nature. Controls of this type allow for precise level adjustments as actually determined by field conditions and provide maximum efficiencies and economies against overusage of solutions. The tanks include a recirculated wash surge/supply tank at 400 gallons nominal, a reused sanitizer surge/supply tank at 200 gallons nominal, a fresh sanitizer surge/supply tank at 200 gallons nominal, a recirculated wash collection tank at 150 gallons nominal, and a used neutralizer collection tank at 150 gallons nominal.

Bottles are machine washed, inside and out simultaneously, using the same cycle times and solutions. The bottles are rotated in front of stationary mounted external spray nozzles. The external spray header supplies fluid to a plurality of stationary mounted spray nozzles mounted around the bottles in the carousel which spray fluid onto the bottles' exterior surfaces as the bottles are transported thereby by the carousel.

The operation specifications of one designed embodiment of the washing machine are:

Caustic Solution

Concentration - variable (0–10%)

Temperature - variable (ambient-212° F.)

Flow rate - nozzle dependent, max 2.5 USGPM

Additives - variable

Disinfectant Solution

Concentration - variable (0–1%)

Temperature - ambient

Flow Rate - nozzle dependent, max 1.5 USGPM)

Additives - variable

Water Rinse

Temperature - ambient

Flow Rate - nozzle dependent, max 2.5 USGPM)

Additives - variable

Nozzles - variable to suit bottle shape, flow rate, spray pattern

Bottle Rotation - variable - clockwise counterclockwise (0–60 rpm)

Figure 4:
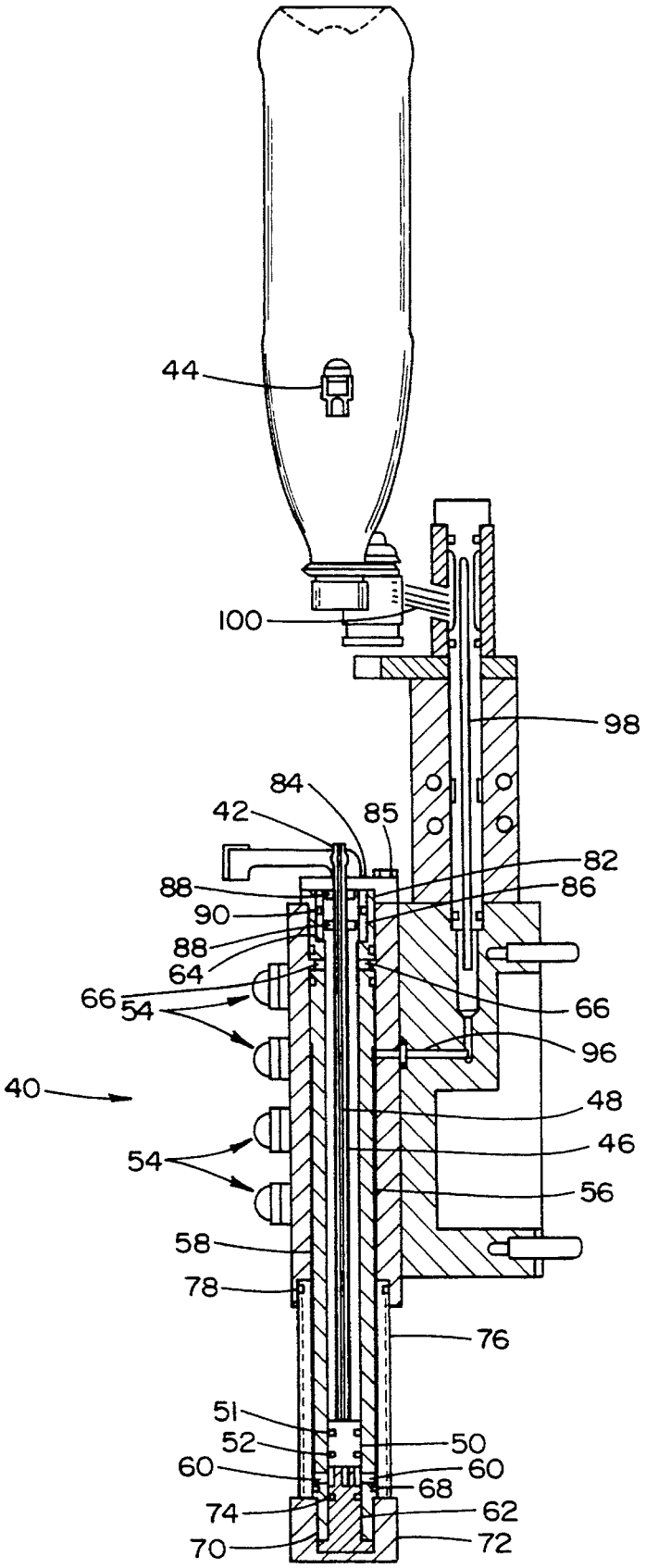
FIG. 4 is a sectional view of a manifold and valve block assembly pursuant to the present invention for the sanitizing carousel, and illustrates details of the drive cylinder and the lance positioned within the drive cylinder, and several cam operated valves for supplying various sanitizing and cleansing fluids and air to the lance.
Figure 6:
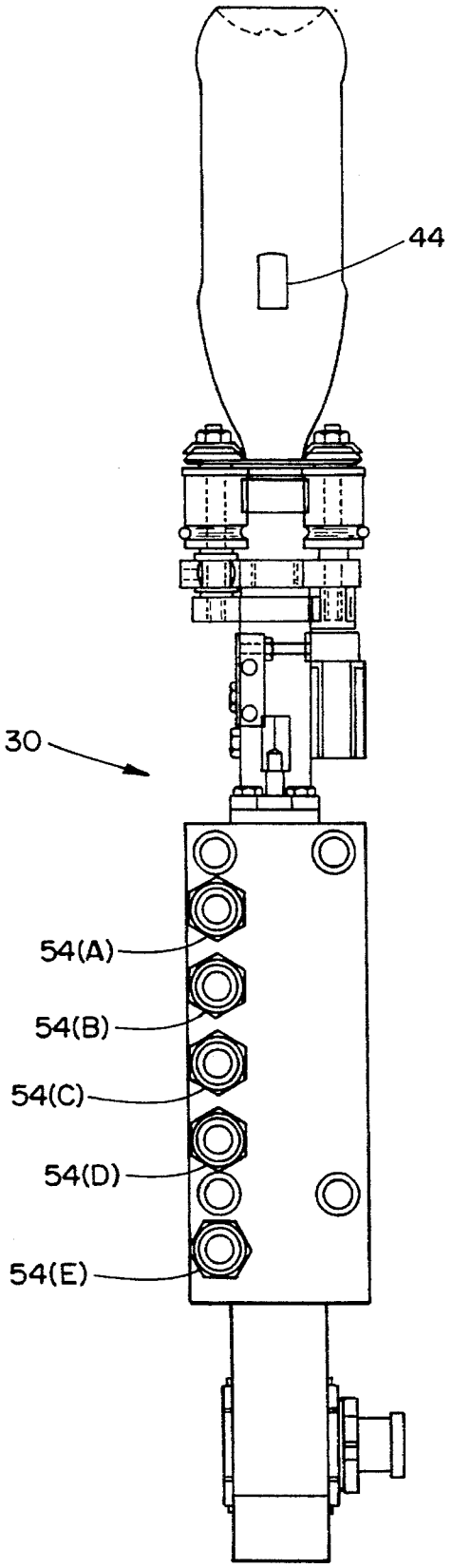
FIG. 6 is an outer and partially sectional view of a manifold and valve block assembly for the wash carousel, and illustrates five supply valves therein and their placement relative to the drive cylinder and retractable lance.

As illustrated by FIGS. 4, 5 and 6, which are three views, each of which is oriented 90° with respect to the other two views (FIGS. 4 and 5 are oriented 180° apart, and FIG. 6 is oriented 90° apart from both FIGS. 4 and 5), each inverted bottle has a separate manifold and valve block assembly 40 associated therewith. Referring to FIG. 4, each separate manifold and valve block assembly 40 includes a central lance 42, which is longitudinally slidable between a first fully withdrawn position, illustrated in FIG. 4, and a second fully extended position, illustrated schematically by the position of a nozzle 44 at the upper end of the lance, shown within the bottle in FIGS. 4–6. The spray nozzle 44 is removably attached by threaded engagement to the top of the lance 42 to allow cleaning or replacement of the spray nozzle. Different spray nozzles having different spray patterns may be provided for different plastic returnable bottles to match the different internal contours and sizes of the various plastic returnable bottles to be washed. During a second 9.43° arc of lead-in time, as illustrated in FIG. 2, the lance is fully extended, driven by fluid pressure supplied thereto, to position the nozzle properly within the bottle, and during a 9.43° arc of lead-out time, as illustrated in FIG. 2, the lance is withdrawn from the bottle, driven downwardly by air pressure to the position shown in FIG. 4.

The lance includes a central stem portion 46, having a central fluid flow passageway 48 therein, and a lower drive piston 50 fitted with one O-ring seal 52 and a Teflon® guide ring 51. The lance is initially driven to its fully extended position by supplying fluid (alkaline wash solution in the wash carousel and sanitizing solution in the sanitizing carousel) under pressure from one of several valves 54 associated with each valve block assembly. The drive piston 50 travels within a stationary drive cylinder 56 within each valve block assembly by the fluid flowing through an appropriate actuated (open) valve 54 into a common annular flow passage or manifold 58 defined around the stationary drive cylinder 56 to ingress orifices 60 near the bottom of the drive cylinder 42 to an open volume beneath the piston defined by a lower resilient snubber 62. The pressurized fluid drives the piston 50 from its lower position in which the bottom of the piston rests upon the top of the lower resilient snubber 62 to a fully extended top position in which the top of the piston is driven against the bottom of an upper resilient snubber 64.

The lance is driven, at an appropriate time, downwardly from its fully extended position to its fully retracted position by static air under pressure which passes through a top static air supply valve 54 through ingress flow orifices 66 near the top of the drive cylinder 56 to the top of the piston 50, in its upper extended position, which drives the piston and lance downwardly, within the drive cylinder 56 until the piston contacts the top of the lower resilient element 62, as illustrated in FIG. 4.

The drive cylinder includes at its lower end an outer O-ring seal 68, immediately below the ingress fluid flow passages 60, and terminates at an externally threaded lower end 70. The lower end is sealed by a bottom end cap 72 which is internally threaded to engage the externally threaded end 70 of the cylinder. The bottom resilient snubber 62 is secured in place between the inside of the threaded cap and the end of the cylinder, and includes an outer annular O-ring seal 74, and extends upwardly therefrom inside the drive cylinder to the ingress fluid flow passages 60. The upper end thereof is shaped to allow fluid flowing through the ingress fluid flow passages 60 to contact the bottom end of the piston at the lower end of the lance to drive the lance upwardly and the fluid then flows through the central passage 48 in the lance to the spray nozzle.

The annular fluid flow passage 58 in the manifold block is continued downwardly, as illustrated in FIG. 4, from the manifold block to the lower cap by a cylindrical extension 76 having an O-ring seal 78 at its upper end to seal to the manifold block, and is sealed at its bottom by the O-ring seal 68 around the bottom of the cylinder 56. The cylindrical extension is held firmly in place by engaging the top of the bottom cap 72.

The upper end of the driving cylinder includes a larger diameter section 82, and the upper end of the driving cylinder is held in place by an upper cap element 84 joined to the manifold block by bolts 85. A top sealing plug 86 is secured in place in the larger diameter section 82 beneath the upper cap member 84 and carries two spaced inner O-ring seals 88 which seal against the outer cylindrical surface of the lance, and an outer O-ring seal 90 which seals against the inner surface of the driving cylinder 56. The top resilient snubber 64 is held in place beneath the top sealing plug 86 and includes a resilient lower surface, against which the upper surface of the driving piston is driven when the lance is extended.

As illustrated particularly by FIGS. 3 and 4, the common supply manifold 58 also communicates by a flow passage 96 with an external spray manifold 98 which supplies fluid to external spray nozzles 100 which are mounted on and rotate with the carousel and spray fluid onto the exterior surfaces of the bottle by the top and neck ring. In some embodiments, the external spray nozzles 100 may not be required, and in these embodiments the flow passages to these nozzles may be blocked, or alternatively the external spray nozzles and flow conduits thereto may be eliminated.

The valves 54 of the valve block assembly are mounted in the manifold block adjacent to the drive cylinder, as shown specifically by FIG. 6 and generally by FIGS. 4 and 5, which view the assembly from opposite directions.

As illustrated in FIGS. 3 and 5, a plurality of annular supply manifolds 32 are secured to the inside of each carousel, which supply a fluid under pressure to the inlet of a supply valve associated with each annular supply manifold. As shown by FIG. 5, each supply manifold 32 communicates by a fluid flow passageway 92 extending from the supply manifold to the intake of an associated valve.

Each valve 54 is actuated at appropriate times, as indicated in FIG. 3, in each of the wash carousel and the sanitize carousel by cam tracks 94 positioned around the outer periphery of each carousel. FIG. 3 shows the simultaneous actuation of the static air valve and the static dump valve, arranged as illustrated in FIG. 6, of the wash carousel 10.

The constructions of the wash carousel and the sanitizing or rinse carousel are substantially similar. In each carousel, the upper supply annulus 32(1) supplies static air under pressure, used to lower the lance near the end of a cycle of each carousel, to each static air supply valve 54(1) in the sanitizer carousel 20 and 54(A) in the washer carousel 10. The wash carousel includes a fifth valve element 54B, shown in FIG. 6, to supply purge air to the wash carousel during the air purge cycle to evacuate alkaline wash solution from the drive cylinder and its associated flow passages and also from the inside of the bottle. As illustrated by FIG. 6, the arrangement of valves in the washer carousel 10 is slightly different from that in the sanitizer carousel 20. In the washer carousel 10, the second valve from the top 54(B) is the air purge supply valve, and the static dump valve 54(E) is now the fifth valve from the top.

The lower annular supply manifold 32(3) supplies alkaline wash solution (NaOH) to the wash carousel during the major wash cycle, and in the rinse carousel supplies sanitizing solution ($HNO_3$) during the major sanitizing cycle. The middle supply annulus 32(2) supplies neutralizer rinse to the wash carousel during the PH rinse cycle, and in the rinse carousel supplies terminal rinse solution (soft water) during the terminal rinse cycle.

The rinse carousel has four valves 54 associated therewith, as illustrated in FIGS. 4 and 5, with the top valve 54(1) supplying static air, the next lower valve 54(2) being a static dump valve. Valves 54(1) and 54(2) are actuated simultaneously during a lance lowering operation with valve 54(1) supplying air through passages 66 to lower the lance and valve 54(2) allowing solution to be driven from the system when the lance is lowered. The next lower valve 54(3) supplies terminal rinse solution during the terminal rinse cycle, and the lowest valve 54(4) supplies sanitizing solution during the sanitizing cycle.

The construction of the manifold valve and block assembly as described hereinabove provides for the ready disassembly of each manifold valve and block assembly, to provide for inspection, cleaning and replacement of the several components thereof. Each end cap 72 can be unscrewed to allow removal of the lower resilient snubber 62, and the cylindrical extension 76. At the upper end, the bolts 85 can be removed, which allows removal of the cap 84, the upper seal plug 86, the upper snubber 64, and the lance stem 46.

Figure 7:
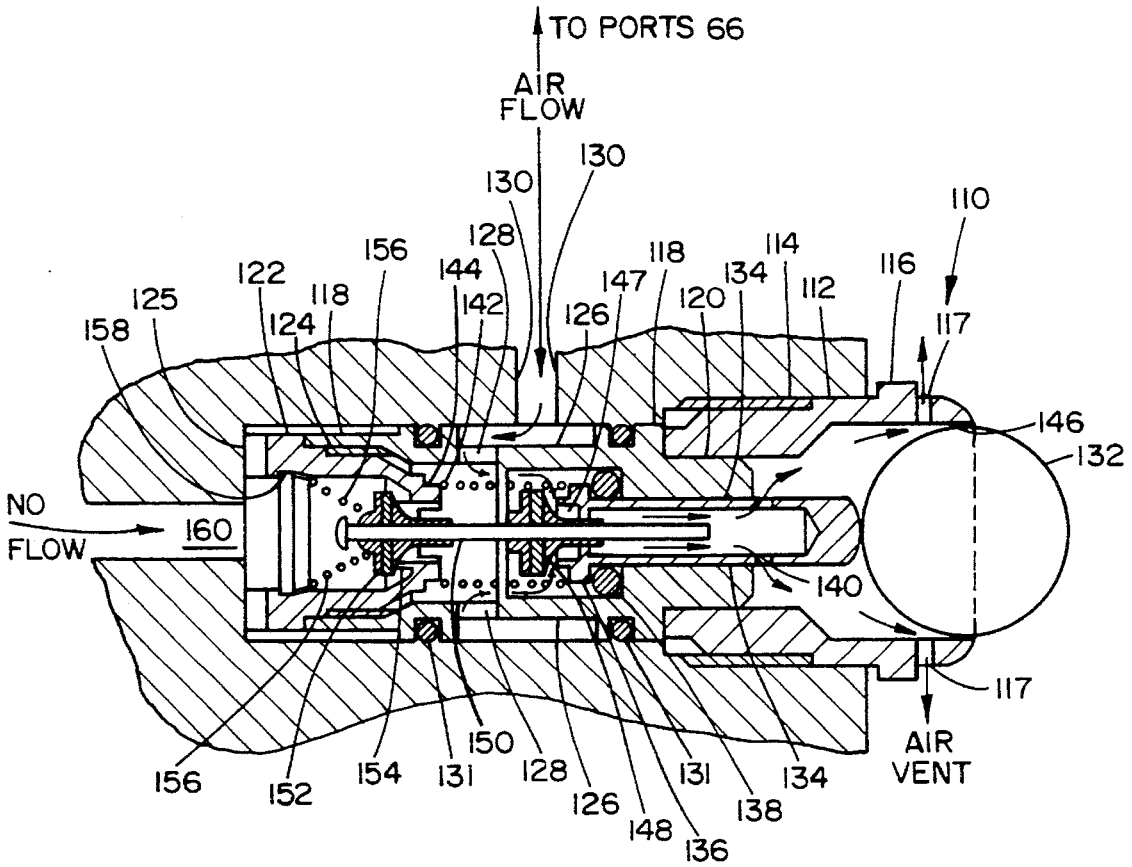
FIG. 7 illustrates a sectional view through one of the static air three-way valves when the valve is in a closed position.
Figure 8:
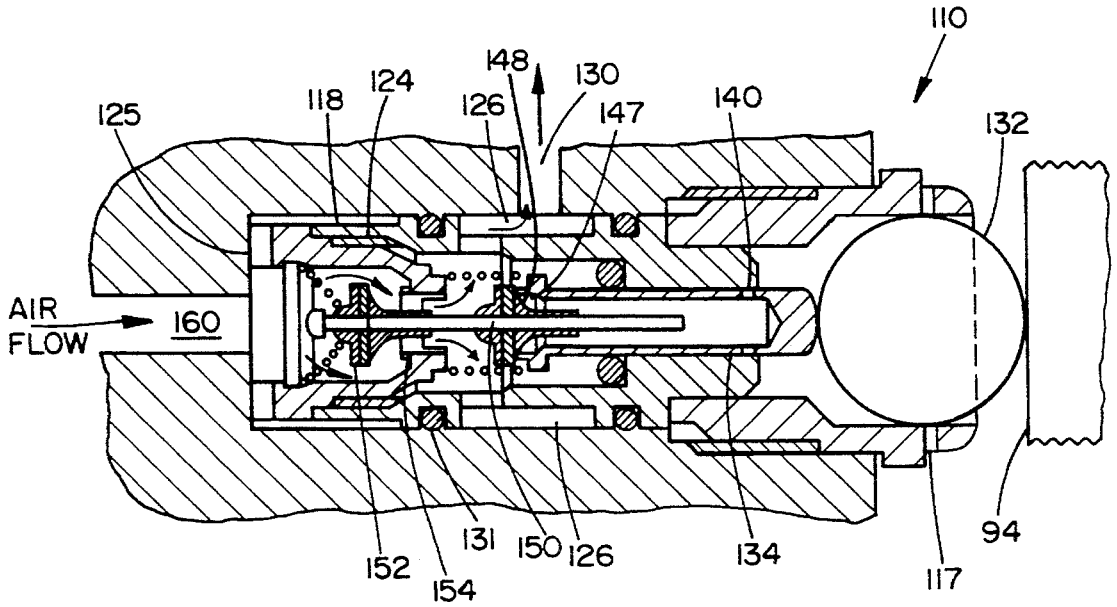
FIG. 8 illustrates a sectional view similar to that of FIG. 7 when the static air three-way valve is actuated to an open position.

FIG. 7 illustrates a sectional view through an exemplary three-way static air actuating valve assembly 110 in a closed position (no static air flow) which shows the path of air being vented through the three-way valve. The air vent path is provided to allow air to be vented from above the drive piston when the lance is being driven from its retracted position to its extended position. FIG. 8 illustrates a sectional view through the valve 110 of FIG. 7 in an open position which allows static air to flow through the valve, but closes off the vent path.

The valve 110 includes a first housing member 112 with external threads 114 which threadedly engage a threaded bore in the manifold housing. A hex head 116 is provided to screw (and unscrew) the valve 110 relative to the manifold housing. A plurality of vent ports 117 are provided in the first housing member 112 adjacent to the hex head 116 which extend between the interior and exterior of the first housing member.

A second housing member 118 includes a reduced diameter right end 120 which is inserted into a cylindrical bore in the left end of the first housing member 112. An end cap 122 closes the left end of the valve assembly and includes outer threads 124 which engage corresponding threads in a bore at the left end of the second housing member 118. The end cap includes a recess 125 at its left end to enable the end cap to be screwed into and out of the second housing member 118. The valve assembly 110 is screwed (by threads 114 and hex head 116) into the manifold housing until the left end of the end cap 122 contacts the manifold housing, which holds all of the components securely in position.

The second housing member 118 includes an outer reduced diameter flow section 126 which communicates with ports 128 communicating with the interior of the second housing member 118, and also communicates with an air flow passage 130 in the manifold housing. Two O-ring seals 131 extend around the circumference of the second housing member 118 to seal it relative to the manifold housing. The valve includes a ball actuator 132 movably mounted within the right end of the first housing member 112 which is actuated (pushed in) by one of the cam rails 94 from the position illustrated in FIG. 7 to the position illustrated in FIG. 8. Upon actuation, the ball actuator 110 linearly displaces to the left a centrally mounted cylindrical actuator 134 movably mounted in a central bore in the second housing member 118. An external flange 136 is provided near the left end of the cylindrical actuator 134, and an O-ring seal 138 is positioned around the cylindrical actuator 134 in an internal bore of the second housing member 118, providing a seal therebetween. The cylindrical actuator 134 is hollow and includes ports 140 near its right end communicating with the interior of the first housing member. A cylindrical spring 142 extends between the external flange 136 of the cylindrical actuator 134 and an annular lip 144 at the right end of the end cap 122, and biases the cylindrical actuator 134 and the ball actuator 132 to the right, until the ball actuator 132 seats against a reduced diameter lip 146 at the right end of the first housing member 112.

When the ball actuator 132 is displaced to the left by a cam rail 94, the cylindrical actuator 134 is displaced to the left until its left end, which forms a vent valve seat 147, is closed against a vent valve member 148 of a centrally mounted valve stem assembly 150. The valve stem assembly 150 includes a main valve member 152, which in the closed position of the valve illustrated in FIG. 7, is closed against a main valve seat 154 formed on the end cap 122. A conical spring 156 extends between an inner annular lip 158 formed in the end cap 122 and the left side of the vent valve member 152, and biases the valve stem assembly 150 to the right, such that in the closed position of the valve illustrated in FIG. 7, the vent valve member 152 is closed against the vent valve seat 154. In this position, the main valve member 148 is open relative to the main valve seat 147.

Accordingly, in the closed position of the valve 110 illustrated in FIG. 7 static air cannot flow (from the static air annular manifold) through an inlet port 160 in the valve 110 past the main valve member 152 which is closed against the main valve seat 154. However, air can be vented from air flow passage 130, through reduced diameter flow section 126, ports 128 into the interior of the second valve housing member 118, through opened vent valve member 148 (opened relative to vent valve seat 147) into the interior of cylindrical actuator 134, through ports 140 into the interior of the first valve housing member 112, and out to the atmosphere through ports 117.

In arriving at the open position of the valve 110 illustrated in FIG. 8, as the ball actuator 132 is displaced to the left by a cam rail 94, the ball actuator 132 displaces the cylindrical actuator to the left, thus closing the vent valve seat 147 against the vent valve member 148, and then displacing the valve stem assembly 150 further to the left, opening the main valve member 152 relative to the main valve seat 154, to the position illustrated in FIG. 8. In this position, static air flows (from the static air annular manifold) through inlet port 160 through opened main valve member 152 to the interior of the second housing member 118, through ports 128, reduced diameter flow section 126, and into the outlet port 130. The outlet port 130 communicates with the inlet ports 66, FIG. 4, to drive the lance 46 to its retracted position.

FIGS. 7 and 8 illustrate the construction of a three-way valve which is used as the static air valve 54(1) of the sanitize carousel 20 and the static air valve 54(A) of the wash carousel 10. The other valve members 54(2) through 54(4) of the sanitize carousel 20 and 54(B) through 54(E) of the wash carousel 10 only require a two-way valve. The construction of each of the two-way valves is substantially identical to that of the three-way valves, except that the two-way valves do not have ports 117 in the first housing member 112 and ports 140 in the cylindrical actuator 134. The advantage of this arrangement is to allow all of the valves to have a substantially similar construction with many common parts. In the two-way valves, only the function of the main valve member 152 and main valve seat 154 is utilized, to allow or foreclose flow from the inlet port 160 to the outlet port 130. In the two-way valves, fluid from the outlet port 130 communicates by flow passageways to the common annular manifold 50, FIG. 4, and then flows through the inlet ports 60 to the central passage 48 of the lance 46, to drive the lance upwardly to its extended position, or if the lance is already in its extended position, to simply spray through the nozzle 44.

While several embodiments and variations of the present invention for a manifold and valve block assembly for a bottle washer are described in detail herein, it should be apparent that the disclosure and teachings of the present invention will suggest many alternative designs to those skilled in the art.

What is claimed is:

1. A manifold and valve block assembly for a bottle cleaning machine comprising:

a. a bottle cleaning machine for cleaning bottles, including a carousel, having a circumference, which has a plurality of bottle mounts around its circumference for mounting a plurality of bottles being cleaned in inverted positions, and each bottle mount on the carousel having a separate manifold and valve block assembly associated therewith and mounted on the carousel; and b. each manifold and valve block assembly comprising, i. a valve block housing, ii. a drive cylinder mounted in said valve block housing, iii. a lance longitudinally movably positioned within said drive cylinder, said lance having a central fluid flow passageway, and also having a spray nozzle on a first upper end thereof, said lance having a retracted position in which the lance is positioned retracted within said drive cylinder and a fully extended position in which the fully extended lance positions said spray nozzle internally within a bottle for spraying a fluid through said nozzle against the internal surfaces of the bottle, and iv. a plurality of valves mounted in said valve block housing for supplying a plurality of spray fluids to a common manifold which provides a fluid passage to said central fluid flow passageway of the lance for fluids to be sequentially sprayed through the nozzle.

2. A manifold and valve block assembly as claimed in claim 1, wherein each valve is actuated by a cam rail for that valve positioned around the circumference of the carousel as the carousel rotates and moves a valve actuator for that valve into contact with its associated cam rail.

3. A manifold and valve block assembly as claimed in claim 2, wherein each valve includes a ball actuator, contacted by said cam rail, which displaces a valve from a valve seat, and spring means for biasing the valve against the valve seat.

4. A manifold and valve block assembly as claimed in claim 1, wherein the carousel includes a plurality of annular fluid supply manifolds positioned around the circumference of the carousel to supply fluid from each annular fluid supply manifold to each of the plurality of associated valves in the plurality of manifold and valve block assemblies positioned around the circumference of the carousel.

5. A manifold and valve block assembly as claimed in claim 4, wherein one annular fluid supply manifold in the carousel supplies static air under pressure to a plurality of static air valves in the plurality of manifold and valve block assemblies positioned around the carousel, and the static air from each static air valve passes to the top of an associated lance in its fully extended position to pneumatically drive the lance downwardly to its retracted position.

6. A manifold and valve block assembly as claimed in claim 5, further including a plurality of static dump valves in said plurality of manifold and valve block assemblies, and wherein during retraction of each lance, a static dump valve is opened simultaneously with each static air valve, which allows fluid within the drive cylinder to be evacuated.

7. A manifold and valve block assembly as claimed in claim 5, wherein each static air valve comprises a three-way valve which, in a first position, allows static air to flow through the valve to the top of its associated lance to pneumatically drive the lance to its retracted position, and in a second position allows air to be vented from the drive cylinder on top of the lance through the valve to the atmosphere, whereby when the lance is driven to its extended position, air from the drive cylinder on top of the lance is vented through the static air valve to the atmosphere.

8. A manifold and valve block assembly as claimed in claim 7, wherein said plurality of valves include several two-way valves, each of which has an open position which allows fluid to flow through the two-way valve to the bottom of the lance to drive the lance to its extended position and to be sprayed through the nozzle, or if the lance is already in its extended position, to be sprayed through the nozzle, and a closed position which prevents the flow of fluid through the valve.

9. A manifold and valve block assembly as claimed in claim 8, wherein said three-way valves and said two-way valves have substantially similar constructions with identical housings and identical valve stem assemblies, with each valve stem assembly comprising a main valve and a vent valve, and each three-way valve differs from each two-way valve by being provided with additional ports to enable operation of the vent valve.

10. A manifold and valve block assembly for a bottle cleaning machine comprising:

a. a bottle cleaning machine for cleaning bottles, including two substantially identical carousels, a first bottle washing carousel and a second bottle sanitizing carousel, and the bottle cleaning machine passes bottles in an inverted position, neck down, first to the bottle washing carousel around which the bottles are rotated to a carousel transfer means for transferring the bottles to the sanitizing carousel around which the bottles are rotated to an exit transfer means for transferring the bottles to an exit conveyor; and b. a manifold and valve block assembly mounted in the bottle cleaning machine and associated with a bottle being washed and comprising, i. a valve block housing, ii. a drive cylinder mounted in said valve block housing, iii. a lance longitudinally movably positioned within said drive cylinder, said lance having a central fluid flow passageway, and also having a spray nozzle on a first upper end thereof, said lance having a retracted position in which the lance is positioned retracted within said drive cylinder and a fully extended position in which the fully extended lance positions said spray nozzle internally within a bottle for spraying a fluid through said nozzle and against the internal surfaces of the bottle, iv. a plurality of valves mounted in said valve block housing for supplying a plurality of spray fluids to a common manifold which provides a fluid passage to said central fluid flow passageway of the lance for fluids to be sequentially sprayed through the nozzle.

11. A manifold and valve block assembly as claimed in claim 10, wherein each carousel includes a plurality of annular fluid supply manifolds positioned around the circumference of the carousel to supply fluid from each annular fluid supply manifold to each of the plurality of associated valves in the plurality of manifold and valve block assemblies positioned around the circumference of the carousel.

12. A manifold and valve block assembly as claimed in claim 11, wherein one annular fluid supply manifold in each carousel supplies static air under pressure to a plurality of static air valves in the plurality of manifold and valve block assemblies positioned around the carousel, and the static air from each static air valve passes to the top of an associated lance in its fully extended position to pneumatically drive the lance downwardly to its retracted position.

13. A manifold and valve block assembly as claimed in claim 12, including a plurality of static dump valves in said plurality of manifold and valve block assemblies, and wherein during retraction of each lance, the static dump valve is opened simultaneously with the static air valve, which allows fluid within the drive cylinder to be evacuated.

14. A manifold and valve block assembly as claimed in claim 12, wherein a second annular fluid supply manifold in the first washing carousel supplies an alkaline wash solution under pressure to a plurality of alkaline wash solution valves in the plurality of manifold and block assemblies positioned around the first washing carousel, and a third annular fluid supply manifold in the first washing carousel supplies an acidic neutralizer solution under pressure to a plurality of acidic neutralizer solution valves in the plurality of manifold and block assemblies positioned around the first washing carousel.

15. A manifold and valve block assembly as claimed in claim 14, further including a plurality of purge air valves in the plurality of manifold and block assemblies positioned around the first washing carousel to purge an associated cylinder, common manifold, and associated fluid flow passages of the fluid currently therein which is sprayed through the spray nozzle followed by purge air.

16. A manifold and valve block assembly as claimed in claim 12, wherein a second annular fluid supply manifold in the second sanitizing carousel supplies an acidic sanitizing solution under pressure to a plurality of acidic sanitizing solution valves in the plurality of manifold and block assemblies positioned around the second sanitizing carousel, and a third annular fluid supply manifold in the second sanitizing carousel supplies treated soft water under pressure to a plurality of treated soft water valves in the plurality of manifold and block assemblies positioned around the second sanitizing carousel.

17. A manifold and valve block assembly, comprising:

a. a valve block housing;

b. a drive cylinder mounted in said valve block housing;

c. a lance longitudinally movably positioned within said drive cylinder, said lance having a central fluid flow passageway, and also having a spray nozzle on a first upper end thereof, said lance having a retracted position in which the lance is positioned retracted within said drive cylinder and a fully extended position in which the fully extended lance positions said spray nozzle for spray impingement of a fluid through said nozzle; and d. a plurality of valves mounted in said valve block housing for supplying a plurality of spray fluids to a common manifold which provides a fluid passage to said central fluid flow passageway of the lance for fluids to be sequentially sprayed through the nozzle, including a static air valve, and the static air from the static air valve passes to air ingress passages near the top of the lance in its fully extended position to pneumatically drive the lance downwardly to its retracted position, and a static dump valve which is opened simultaneously with the static air valve, to allow fluid within the drive cylinder to be evacuated.

18. A manifold and valve block assembly, comprising:

a. a valve block housing;

b. a drive cylinder mounted in said valve block housing;

c. a lance longitudinally movably positioned within said drive cylinder, said lance having a central fluid flow passageway, and also having a spray nozzle on a first upper end thereof, said lance having a retracted position in which the lance is positioned retracted within said drive cylinder and a fully extended position in which the fully extended lance positions said spray nozzle for spray impingement of a fluid through said nozzle; and d. a plurality of valves mounted in said valve block housing for supplying a plurality of spray fluids to a common manifold which provides a fluid passage to said central fluid flow passageway of the lance for fluids to be sequentially sprayed through the nozzle, including a static air valve, and the static air from the static air valve passes to air ingress passages near the top of the lance in its fully extended position to pneumatically drive the lance downwardly to its retracted position, and wherein said static air valve comprises a three-way valve which, in a first position, allows static air to flow through the valve to the top of the lance to pneumatically drive the lance to its retracted position, and in a second position allows air to be vented from the drive cylinder on top of the lance through the valve to the atmosphere, whereby when the lance is driven to its extended position, air from the drive cylinder on top of the lance is vented through the static air valve to the atmosphere.

19. A manifold and valve block assembly as claimed in claim 18, wherein said plurality of valves include several two-way valves, each of which has an open position which allows fluid to flow through the two-way valve to the bottom of the lance to drive the lance to its extended position and to be sprayed through the nozzle, or if the lance is already in its extended position, to be sprayed through the nozzle, and a closed position which prevents the flow of fluid through the valve.

20. A manifold and valve block assembly as claimed in claim 19, wherein said three-way valve and said two-way valves have substantially similar constructions with identical housings and identical valve stem assemblies, with each valve stem assembly comprising a main valve and a vent valve, and each three-way valve differs from each two-way valve by being provided with additional ports to enable operation of the vent valve.

21. A manifold and valve block assembly for a container processing machine comprising:

a. a container processing machine including a conveyor which conveys a plurality of containers being processed through the container processing machine in inverted positions, and each container on the conveyor having a separate manifold and valve block assembly associated therewith which is movably mounted in the container processing machine; and b. each manifold and valve block assembly comprising, i. a valve block housing, ii. a drive cylinder mounted in said valve block housing, iii. a lance longitudinally movably positioned within said drive cylinder, said lance having a central fluid flow passageway, and also having a spray nozzle on a first upper end thereof, said lance having a retracted position in which the lance is positioned retracted within said drive cylinder and a fully extended position in which the fully extended lance positions said spray nozzle internally within a container for spraying a fluid through said nozzle and against the internal surfaces of the container, and iv. a plurality of valves mounted in said valve block housing for supplying a plurality of spray fluids to a common manifold which provides a fluid passage to said central fluid flow passageway of the lance for fluids to be sequentially sprayed through the nozzle.

22. A manifold and valve block assembly as claimed in claim 21, wherein each valve is actuated by a cam rail for that valve positioned along the conveyor which moves a valve actuator for that valve as the valve actuator moves into contact with its associated cam rail.

23. A manifold and valve block assembly as claimed in claim 22, wherein each valve includes a ball actuator, contacted by said cam rail, which displaces a valve from a valve seat, and spring means for biasing the valve against the valve seat.

24. A manifold and valve block assembly as claimed in claim 21, wherein each of the plurality of manifold and valve block assemblies includes a static air valve, and the static air from each static air valve passes to the top of an associated lance in its fully extended position to pneumatically drive the lance downwardly to its retracted position.

25. A manifold and valve block assembly as claimed in claim 24, wherein each of the plurality of manifold and valve block assemblies includes a static dump valve, and during retraction of each lance, the static dump valve is opened simultaneously with the static air valve, which allows fluid within the drive cylinder to be evacuated.

26. A manifold and valve block assembly as claimed in claim 24, wherein the static air valve comprises a three-way valve which, in a first position, allows static air to flow through the valve to the top of its associated lance to pneumatically drive the lance to its retracted position, and in a second position allows air to be vented from the drive cylinder on top of the lance through the valve to the atmosphere, whereby when the lance is driven to its extended position, air from the drive cylinder on top of the lance is vented through the static air valve to the atmosphere.

27. A manifold and valve block assembly as claimed in claim 26, wherein said plurality of valves include several two-way valves, each of which has an open position which allows fluid to flow through the two-way valve to the bottom of the lance to drive the lance to its extended position and to be sprayed through the nozzle, or if the lance is already in its extended position, to be sprayed through the nozzle, and a closed position which prevents the flow of fluid through the valve.

28. A manifold and valve block assembly as claimed in claim 27, wherein said three-way valves and said two-way valves have substantially similar constructions with identical housings and identical valve stem assemblies, with each valve stem assembly comprising a main valve and a vent valve, and each three-way valve differs from each two-way valve by being provided with additional ports to enable operation of the vent valve.

29. A manifold and valve block assembly as claimed in claim 21, wherein each of the plurality of manifold and block assemblies includes a purge air valve to purge an associated cylinder, common manifold, and associated fluid flow passages of the fluid currently therein which is sprayed through the spray nozzle followed by the purge air.

* * * * *